US008011429B2

(12) United States Patent
McNay

(10) Patent No.: US 8,011,429 B2
(45) Date of Patent: Sep. 6, 2011

(54) TRANSPORT ASSEMBLY

(76) Inventor: Graeme McNay, Aberdeen (GB)

( * ) Notice: Subject to any disclaimer, the term of this patent is extended or adjusted under 35 U.S.C. 154(b) by 120 days.

(21) Appl. No.: 12/163,058

(22) Filed: Jun. 27, 2008

(65) Prior Publication Data

US 2009/0003974 A1 Jan. 1, 2009

(30) Foreign Application Priority Data

Jun. 29, 2007 (GB) ..... 0712629.5

(51) Int. Cl.
*E21B 43/00* (2006.01)
*E21B 17/10* (2006.01)

(52) U.S. Cl. ..... 166/241.3; 166/241.1; 166/241.6; 175/325.5; 175/325.3; 175/325.2; 175/262; 175/76

(58) Field of Classification Search ..... 166/241.1, 166/241.3, 241.6, 241.7; 175/325.3, 76, 175/262, 325.1, 325.2, 325.5
See application file for complete search history.

(56) References Cited

U.S. PATENT DOCUMENTS 2,466,239 A 4/1949 Holcombe
5,092,412 A 3/1992 Walk
5,148,876 A * 9/1992 Wilson ..... 175/325.3
6,227,316 B1 5/2001 Rohde
6,688,409 B1 * 2/2004 Murray ..... 175/325.3
2005/0252655 A1 * 11/2005 McKay et al. ..... 166/241.7
2005/0252694 A1 * 11/2005 Kennedy et al. ..... 175/406

FOREIGN PATENT DOCUMENTS

GB 2351512 1/2001
GB 2429483 2/2007

* cited by examiner

*Primary Examiner* — William P Neuder
*Assistant Examiner* — Elizabeth Gottlieb
(74) *Attorney, Agent, or Firm* — DLA Piper LLP (US)

(57) ABSTRACT

A transport assembly configured to be attached to downhole apparatus has a support assembly configured to be attached to the downhole apparatus and a ground engaging assembly, which may be a roller wheel configured to contact with and move in relation to a surface of a wellbore. The roller wheel may engage with the support assembly so as to provide for their relative rotation. The transport assembly also includes a retaining member disposed between the roller wheel and the support assembly, and the retaining member is operable to resist separation of the roller wheel from the support assembly. The transport assembly is further configured such that, when the transport assembly is in use moving along a wellbore, the roller wheel bears against the retaining member, which in turn bears against the support assembly. The retaining member is a ball-bearing.

34 Claims, 2 Drawing Sheets

TRANSPORT ASSEMBLY

CROSS REFERENCE TO RELATED APPLICATION

This application claims priority to British Patent Application No. 0712629.5, filed Jun. 29, 2007, the entire contents of which are incorporated by reference herein.

TECHNICAL FIELD

The present invention relates to a transport assembly adapted to be attached to downhole apparatus. In one particular embodiment, it relates to a transport assembly that may be used to facilitate movement of tubing and/or tool strings through oil or gas wellbores.

BACKGROUND

In many fields it is desirable to support and move equipment with the assistance of some form of transport assembly, such as for example, a roller or wheel assembly. In the oil and gas industry, such transport assemblies are of particular use in connection with the deployment: of wellbore apparatus, such as tool strings, tubing strings or other equipment which may need to be deployed and transported into position in a wellbore for different operations.

In the case of a deviated wellbore where a longitudinal axis of the wellbore is non-vertical (and sometimes horizontal), gravity tends to force the string toward a lower wall of the wellbore, leading to high friction between the wall of the wellbore and the string. In such circumstances, it can be a particular challenge to move a string through the wellbore, and roller-based transport assemblies are of particular use to provide stand off of the string from the wellbore wall and to facilitate low friction transport of the string through the well.

Such transport assemblies have a "roller" that contacts the wellbore wall and provides support for the string to keep sections of the string off the wall easing resistance against the string. In addition, the roller may turn on engagement with the wellbore wall.

There are a number of difficulties associated with existing transport assemblies for downhole apparatus. High temperatures and pressures often persist downhole, and wellbore fluids carrying mud rock cuttings are often circulated through the well. This presents a harsh, environment which can cause, wear on equipment. Also, the working environment on site both onshore and offshore can also be demanding. Often, space is limited and strict safety guidelines must be followed. The weather conditions may also present difficulties to personnel. In these conditions, existing equipment can be difficult and inconvenient to handle and maintain. Site operations can therefore be time consuming and costly.

It is amongst the aims of the present invention to obviate or at least mitigate shortcomings of existing transport assemblies.

SUMMARY OF THE INVENTION

According to a first aspect of the present invention there is provided a transport assembly configured to be attached to downhole apparatus, the transport assembly comprising:

a support assembly configured to be attached to the downhole apparatus;

a ground engaging assembly configured to contact with and move in relation to a surface of a wellbore, the ground engaging assembly engaging with the support assembly so as to provide for their relative rotation, in which the transport assembly further comprises at least one retaining member disposed between the ground engaging assembly and the support assembly, the at least one retaining member being operable to resist separation of the ground engaging assembly from the support assembly, the transport assembly being further configured such that, when the transport assembly is in use moving along a wellbore, the ground engaging assembly bears against the at least one retaining member and the at least one retaining member bears against the support assembly.

In use, a weight of the transport assembly and a downhole apparatus to which the transport assembly is attached may be borne by the ground engaging assembly with the ground engaging assembly bearing against the at least one retaining member, which in turn bears against the support assembly.

More specifically, the transport assembly may be configured such that the at least one retaining member provides for freedom of movement of the ground engaging assembly and the support assembly in relation to each other.

More specifically, the at least one retaining member may be movable in relation to each of the ground engaging assembly and the support assembly.

Alternatively or in addition, the retaining member may be substantially spherical. Thus, the retaining member may be a ball-bearing. This helps to reduce and/or minimize frictional resistance felt by parts of the support assembly and ground engaging assembly as they bearing against the ball bearing and move with respect to each other. Where there is a plurality of retaining members, the ball-bearings may have different diameters.

The use of ball-bearings facilitates rotation of the ground engaging assembly when forces are imparted at an acute angle to an axis of rotation of the ground engaging assembly.

Alternatively or in addition, the ground engaging assembly and the support assembly may define a space in which the at least one retaining member is held.

More specifically, one of the ground engaging assembly and the support assembly may define a recess for receiving a part of the other of the ground engaging assembly and the support assembly.

More specifically, the ground engaging assembly may define a part receiving recess for receiving a part of the support assembly.

More specifically, the part receiving recess may extend in a direction substantially in line with and/or parallel to a surface over which the transport assembly moves when in use. The surface may be an outer cylindrical surface of the support member.

The support assembly may comprise a support member comprising a first, inner end adapted to be attached to the downhole apparatus and a second, outer end, and the part receiving recess may be adapted to receive the outer end of the support member, which may be cylindrical in form.

Alternatively or in addition, each of the ground engaging assembly and the support assembly may define a retaining recess and the at least one retaining member may extend in part into each of the retaining recesses.

More specifically and where one of the ground engaging assembly and the support assembly defines a part receiving recess, the retaining recesses may extend substantially radially of a direction in which the part receiving recess extends. Thus separation of the ground engaging assembly and the support assembly may be resisted.

Thus, the retaining recess may be formed in a side wall of the part receiving recess.

The support assembly and/or the ground engaging assembly may comprise a slot, rim, flange, circumferential groove, track, bore, hole or the like, for defining the retaining recess defined in the support assembly and/or the ground engaging assembly. The retaining recess of the support assembly and/or the ground engaging assembly may define a space in which the retaining member is held and/or is occupied.

Alternatively or in addition, the transport assembly comprises a plurality of retaining members, the retaining members being spaced apart around the part of the support assembly received in the ground engaging assembly.

Alternatively or in addition, the transport assembly may comprise an aperture configured to admit the at least one retaining member.

More specifically, the transport assembly may define a passageway between the aperture and a space defined by the ground engaging assembly and the support assembly, the space holding the at least one retaining member in its operative position. Thus, the at least one retaining member may be introduced to the space via the aperture and pathway. In addition, the at least one retaining member may be removed from the space via the aperture and pathway to, for example, allow for removal of the ground engaging assembly from the support assembly.

The pathway may comprise an internal passageway formed in a part of the ground engaging assembly and/or the support assembly. Thus, the retaining member can be introduced via an aperture provided at a point accessible to a user and located into position by inserting or removing the element to the space through the aperture and the pathway an internal conduit formed in the support assembly. The aperture may be provided in a body of the downhole apparatus.

Alternatively or in addition, the transport assembly may further comprise pressure equalizing apparatus operative to equalize a pressure in the space in which the at least one retaining member is held with an ambient pressure.

More specifically, the pressure equalizing apparatus may be disposed in a passageway defined between the aperture and the space defined by the ground engaging assembly.

Alternatively or in addition, pressure equalizing apparatus comprises a closing body which, in use, is inserted into the passageway to close the passageway, e.g. after introduction of retaining members.

More specifically, the closing body may define a bore that is operative to equalize the pressure in the space in which the at least one retaining member is held with the ambient pressure.

The ground engaging assembly may comprise contact means adapted to be operable upon contact with a wall of the wellbore. The contact means may be adapted to rotate with respect to the support assembly. The retaining member may be operable to guide rotation of the contact means and/or ground engaging means with respect to the support assembly.

Thus, the retaining member may have a number of different functions, which helps mitigate any need otherwise to provide separate elements to provide such functions. This helps to reduce potential design complexity and costs.

The ground engaging assembly and/or the contact means and/or contact member may comprise a circular disc, a roller and/or a wheel for contacting a wellbore wall. More specifically, the disc and/or wheel may be configured to contact a curved surface, such as for example the inner surface of a wellbore wall. In this regard, the ground engaging assembly, the contact means and/or contact member may include an outer surface. The disc, roller and/or wheel may comprise a dome-shaped, concave, rounded and/or convex outer surface.

The outer surface may be a continuous surface. The outer surface may be a shaped surface, and may be a rounded and/or dome-shaped surface, for providing a large area of contact of the outer surface with a wellbore wall and/or for providing the transport assembly with a low profile when in use in a wellbore. The outer surface may be profiled which may facilitate grip in certain applications, for example, where the transport assembly is adapted to be driven, for example by a motor, for example when the transport assembly is attached to a wellbore traction apparatus.

The outer surface may be shaped such that upon contact with a wall of the wellbore, the surface may deflect, tip, urge, initiate rotation, and/or pivot the assembly into a different orientation and/or rotational position within the wellbore. The surface may be adapted to engage a wall of a wellbore to move or rotate the assembly with respect to a wellbore tubing string. The surface may be adapted to be fixedly connected to a section of a wellbore tubing string and may engage with a wall of the wellbore to move and/or rotate the tubing section. The assembly may be attached to and/or clamped around the tubing string. Thus, upon forces imparted to the outer surface, the tool assembly may self-rotate into an optimum orientation.

Preferably, the ground engaging assembly forms a unitary body. Preferably also, the support assembly forms a unitary body. In such an embodiment, the transport assembly is formed of few pieces facilitating installation and low maintenance.

According to a second aspect of the present invention there is provided downhole apparatus comprising a transport assembly according to the first aspect of the present invention.

Further, the downhole apparatus may comprise a grease point access port. This port is configured to allow access of grease to the space in which the at least one retaining member is held. Thus, the grease can be applied through the port to the retaining member to provide lubrication to the retaining member and facilitate proper operation of the transport assembly. The port can be located at a convenient point to allow grease to be applied to the ground engaging assembly quite readily from a convenient point without having to disassemble and detach the ground engaging assembly. In certain embodiments, the closing body may be adapted to allow grease to escape from the space in which the at least one retaining member is held, e.g., when the space is filled with grease. Thus, the escape of grease (via the closing body) acts to indicate that grease has been successfully applied to foe retaining member.

Preferably, the assembly comprises a seal adapted to be provide a seal between a part of the ground engaging assembly and a part of the support assembly and/or the downhole apparatus for preventing ingress of dirt, debris and particles from the wellbore from accessing the retaining member and interfering with operation of the transport assembly. The ground engaging assembly and/or the support assembly may comprise a recess for receiving the seal. The seal may be a V-seal adapted to flexibly extend between a part of the support assembly and a part of the ground engaging assembly. The seal may be formed from at least one of: a rubber, plastics or other synthetic material. The seal may be formed from Teflon®.

The main body may comprise two sections attached together using fixing screws. The main body may have a threaded portion at first and second ends of the main body for attaching the main body to an adjacent section of string and/or another wellbore tool or other wellbore apparatus.

More specifically, the downhole apparatus may comprise a plurality of discs and/or wheels for contacting a wall of the wellbore.

Two discs/wheels of may be coupled to respective outer ends of support members of the support assembly. The support members may define: a radial axis of the downhole tool and/or transport assembly, perpendicular to the longitudinal axis of the main body and/or the longitudinal axis of the wellbore and/or the direction of transport.

The wheels and/or discs may have rounded outer surfaces, which may be continuous surfaces. This facilitates engagement and helps maximize contact surface area with the internal walls of a wellbore, which also have a certain curvature. The curved outer surface also provides for a low profile construction, and helps to keep the centre of gravity toward the centre axis of the main body, facilitating maneuverability and stability of the downhole apparatus. Also, the outer surface shape helps to maintain performance, particularly where the point of contact with and force imparted by the wellbore wall forms an angle of up to around 15 degrees, of the radial axis. The wheels may be adapted to rotate around the radial axes.

This facilitates engagement of the surface engagement means with the wellbore wall while the tool is positioned off axis in the wellbore.

According to a further aspect of the present invention there is provided a transport assembly configured to be attached to downhole apparatus, the transport assembly comprising:

a support assembly configured to be attached to the downhole apparatus;

a ground engaging assembly configured to contact with and move in relation to a surface of a wellbore, the ground engaging assembly engaging with the support assembly so as to provide for their relative rotation.

Within this further aspect of the invention, the assembly may include any of the features defined above in relation to the first and/or second aspects, where appropriate.

BRIEF DESCRIPTION OF THE DRAWINGS

There will now be described, by way of example only, embodiments of the invention, with reference to the following drawings, of which.

DETAILED DESCRIPTION OF THE DRAWINGS

Figure 1:
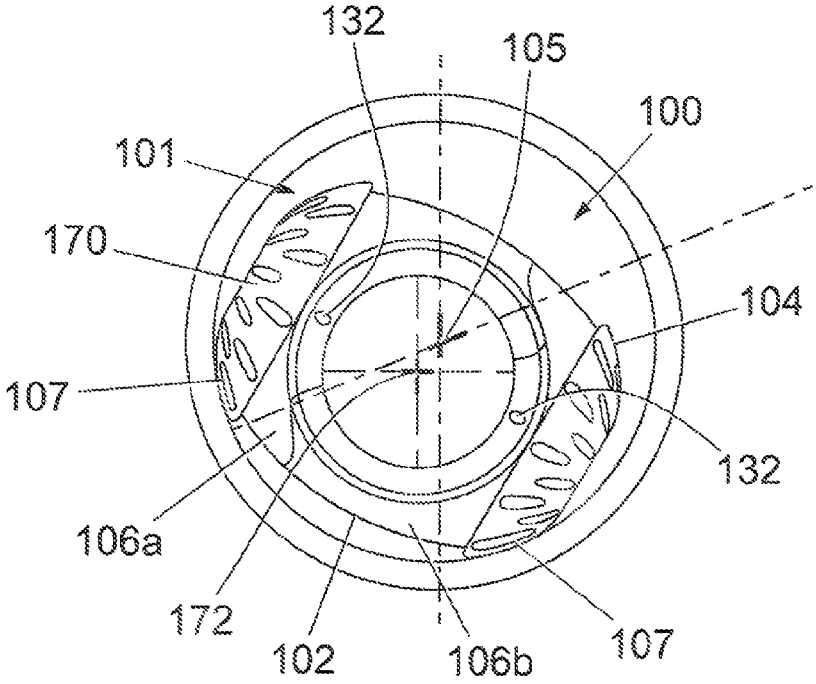
FIG. 1 is cross-sectional drawing a downhole roller apparatus in operation in a wellbore looking along a longitudinal axis of the wellbore, according to an embodiment of the invention.

With reference firstly to FIG. 1, there is shown a downhole roller apparatus 100 (constituting a transport assembly) in an assembled configuration located in a wellbore 101. In this position, the apparatus 100 is connected at upper and lower ends to adjacent sections of a tubing string (not shown), providing support for the string.

The roller apparatus 100 comprises a support assembly in the form of a tubular main body 102, which in turn is comprised of two body halves 106*a,b*. In FIG. 1, the roller apparatus 100 is shown as assembled with roller wheels 104 (forming a part of a ground engaging assembly) connected to the main body 102.

Further, the apparatus 100 is positioned toward a lower side of the wellbore off the central axis 105, the main longitudinal axis 172 of the tubular main body 102 is shown in FIG. 1, and an outer surface 107 of the roller wheels 104 are in contact with a wall of the wellbore providing stand off of the main body of the apparatus and adjacent tubing string sections from the wellbore wall for facilitating movement of the apparatus and string through the wellbore along the longitudinal axis 105.

Figure 2:
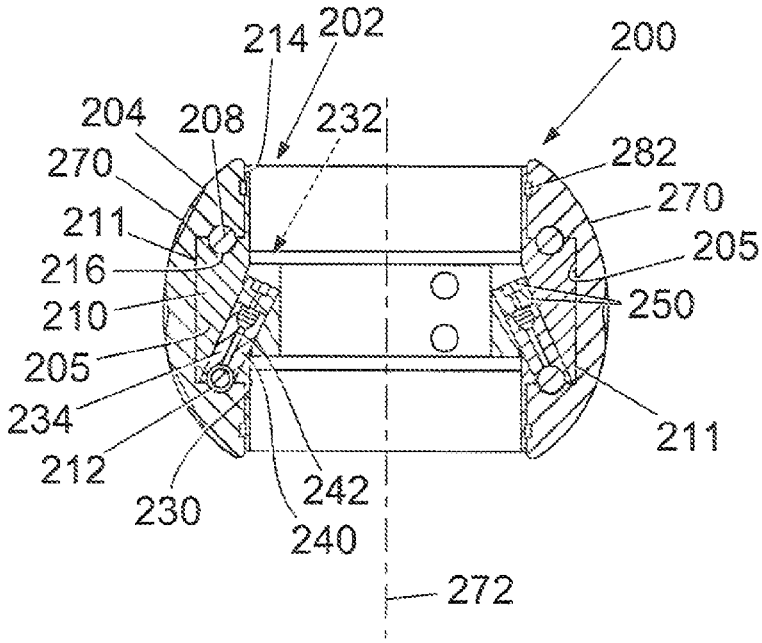
FIG. 2 is a partial cross-sectional representation of a downhole roller apparatus as shown in FIG. 1, but assembled with an alternative roller wheel according to a further embodiment of the invention.

With further reference to FIG. 2, a roller apparatus 200 (separated from the wellbore), is shown comprising similar components as that of FIG. 1, except the roller wheels 204 are configured differently with a different outer surface profile. In this embodiment, components corresponding to those of FIG. 1 have the same reference numerals incremented by one hundred.

In FIG. 2, the internal structure of the apparatus 200 is shown. In particular, the apparatus is shown to comprise ball-bearings 208 (constituting at least one retaining member) located between an inner surface of the roller wheels 204, and an outer surface of a protruding support member 210 of the main body 202. The roller wheel 204 bears against the ball-bearings, which in turn bear against the support member 210. The ball-bearings 208 function to prevent or resist separation of the roller wheels 204 from the main body 202. In this embodiment, the ball bearings are received in a space 212 extending circumferentially around an outer surface of the support member 210, which has generally a cylindrical form. A number of ball bearings 208 are received in the space to spread the loads. The apparatus is provided a first retaining recess 214 formed in the inner surface of the roller wheel 204, and a second retaining recess 216 formed in the outer surface of the support member 210, which are aligned with each other defining the circumferential space 212 for the bearings.

The roller wheels 204 are connected to an outer end of the support member 210 via the ball-bearings in a close fitting relationship such that there is little more than a clearance gap between the inner surface of the roller wheel 204 and the outer surface of the support member 210. More specifically, the roller wheels 204 are provided with a recess 205 (constituting a part receiving recess) into which an end 211 of the support member 210 is received. Further, the ball-bearings are of a similar diameter to the circumferential space 212. In this configuration as shown in FIG. 2, the ball bearings 122 will therefore abut the walls of the retaining recesses so that the bearings function to prevent separation and detachment of the wheels by forces applied to the wheels, for example while the apparatus 200 is being run in the wellbore.

In addition to keeping the wheels 204 in position and coupled to the main body 202, the ball bearings 208 act to provide a low resistance coupling between the wheel and the support member 210 and allows for the wheels 204 to rotate with a degree of freedom about the support member 210, upon engagement with a wall of the wellbore.

The ball-bearings are inserted into the space 212 through an internal passageway 230 formed in the support member 210 and main body 202 of the downhole apparatus 200. An access aperture 232 providing access to the passageway 230 is provided in an internal wall of the tubular main body 202. This aperture can be seen in the embodiment of FIG. 1 at reference numeral 132.

The passageway 230 extends between the aperture 232 through the main body and the support member 210 and the space 212 for receiving the ball-bearings 208. A second outlet aperture 234 at the other end of the passageway 230 is provided in the retaining recess 216. Thus, the passageway 232 is used to insert and/or remove the ball bearings 122 from the space, for example if maintenance is required or to install or change out the roller wheels 204.

Once the balls have been inserted in the space 212 as described, and the apparatus 200 is assembled and ready for use as shown in FIGS. 1 and 2, an insert 240 (constituting a closing body) is located in the passageway 230 to fill the outlet aperture such that the ball bearings are not able to escape unwontedly from the space 212 and out through the passageway 230.

The insert in this case is formed from brass and comprises a central bore 242 to allow for air to escape while being inserted into the passageway 230, thereby equalizing a pressure of passageway with an ambient pressure. Further, an upper portion of the bore 242 and an upper portion of the passageway 230 near the access aperture is threaded allowing locking screws 250 to be inserted to secure the insert into position, and to seal off the bore 242 and passageway 230.

In other embodiments, the insert is formed from other suitable materials, such as steel or non-metallic materials, such as plastics or composite materials.

The roller wheels 104, 204 of the above embodiments have continuous outer surfaces 170, 270 of different shape. More specifically, the surface 170 has a flattened centre region, whereas the surface 270 is curved the full way across it. The wheel being attached as outlined above allows different wheels to be readily interchanged for example to replace existing wheels with ones of a different shape depending on requirements, such as wellbore curvature. The wheels 104, 204 are examples of two alternatives. In other embodiments, wheels with more accentuated curvature may be used for example to engage effectively with smaller diameter wellbore wall sections.

With reference particularly to FIG. 2, the wheel 204 is curved or has a dome-shaped provide across the surface 270. Thus, the surface 270 has a contour that follows the curvature of wellbore walls of a similar diameter, such that the surface 270, when brought into contact with the wellbore wall, has a relatively large area that is in contact. This also assists with engagement of the wheels and helps them to rotate when brought into contact with the wellbore wall when the tool is tilted with respect to the vertical. The domed shape of the wheel surface 270 also helps to tip and/or rotate the apparatus upon contact with the wellbore wall or other component of the wellbore into a different rotational position. The weight of the apparatus assists to move it into an equilibrium orientation.

Further, the wheels 204 can rotate around the support members 210 around coincident radial axes that extend radially of the main body 202 and perpendicular to a main longitudinal axis 272 of the tubular main body. Further the outer surfaces 270 of the wheel extend and curve around to cover outer ends of the support members 210 to which the wheels are attached. This gives the tool a low profile in the wellbore, and allows it to operate in narrow wellbores. Further, as with conventional arrangements, the use of ball-bearings 208 allows the wheels to rotate where forces are applied to the wheel surface at an acute angle to the radial axes of rotation of the wheels. In this case, this can be beneficial, when the apparatus tilted with respect to the wellbore as shown in FIG. 1.

Further, due to the shape of the wheels, the centre of gravity of the apparatus is kept closer and more evenly distributed around the centre axis 272 of the apparatus 202, to give stability and maneuverability to the apparatus.

As can be seen in FIG. 2, the downhole roller apparatus 200 is further provided with a circumferential seal 282 located around the support member 210 between an inner surface of the roller wheel 202 and an outer surface of the main body 202. The seal 282 acts to prevent ingress of dirt and other debris from passing between the wheel 204 and the main body 202 and into the space 212 and ball-bearings 208. Thus, it helps with proper operation of the wheels. In this case, the seal is a V-seal, which sits in recesses provided in the support member 210 and the roller wheel 202. The V-seal is formed from TEFLON®, and extends between the outer surface of the main body and the wheel to cover any gap that may occur during use between the outer surface of the main body and the wheel.

Figure 3:
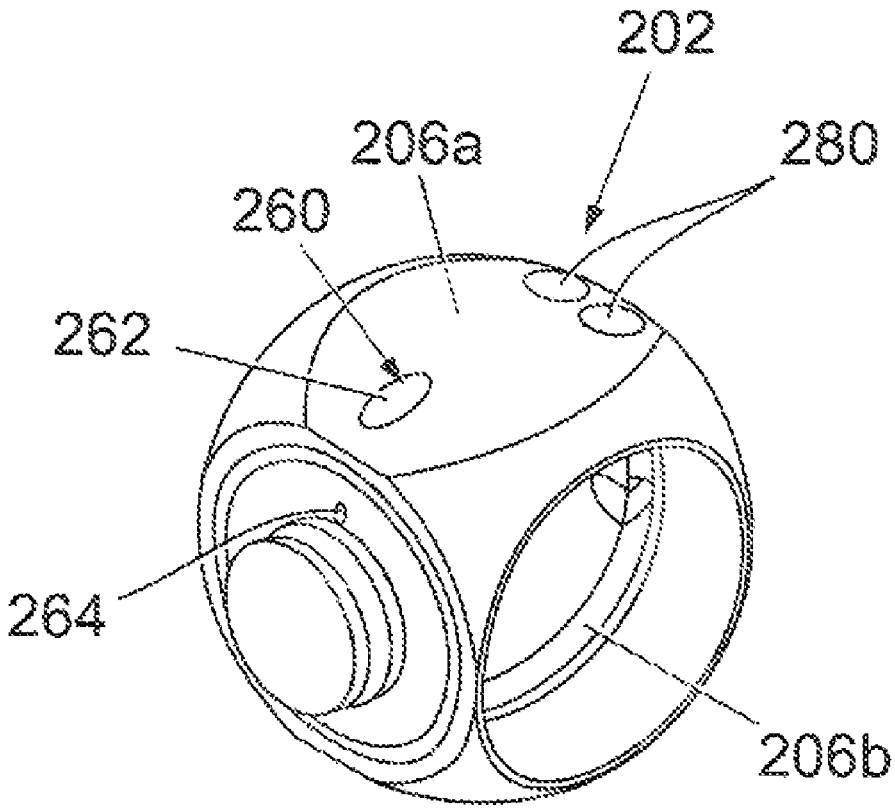
FIG. 3 is a perspective view of a support assembly of the downhole roller apparatus of FIGS. 1 and 2, showing a grease access point and connection mechanisms.

Further, to facilitate with rotation of the wheels, the roller apparatus of FIGS. 1 and 2 is provided with a "grease point" 260, which can be seen with further reference to FIG. 3, which shows in isolation the main body 202 of the roller apparatus 200, the wheels having been detached.

At the grease point 260, the main body 202 is provided with an access passage from a grease access port 262 to a grease outlet port 264 to provide grease to the ball-bearings, and the region between the inner surface of the wheel and the outer surface of the main body where the surfaces move past each other upon movement and rotation of the wheel. The outlet 264 is located "inside" the seal such that grease can access the ball, bearings. The access port is provided on an outer surface of the main body, allowing the grease to be injected through the port to lubricate the wheels with relative ease, and while the apparatus is incorporated in a tubing string during operations.

FIG. 3 also shows the main body having connection bores 280 provided in the first body half 206*a*. These align with corresponding bores (not shown) of the second body half 206*b*, and to attach the two halves together, screws (not shown) are inserted which engage with the aligned bores of the first and second halves to secure them together thereby forming the tubular main body 202. In this way, the main body may be clamped around a wellbore tubing section to attach it to the section.

After use or for maintenance, the apparatus as described above can be readily disassembled and the wheels detached. The main body of the apparatus is removed from the wellbore and the apparatus is disconnected from adjacent string sections. The access apertures 232 are opened up, the inserts 240 are removed from the passageways 230 and the ball bearings are tipped out of the space 212. A magnetic "pen" tool may be used to attract the ball bearings and draw them out through the passageway if the bearings comprise magnetic materials. Once the bearings are removed, the wheels are lifted off, and the various components can be maintained.

The present invention provides a number of advantages. In particular, the attachment of roller wheels via the retaining ball-bearings is beneficial because they serve the dual purpose of attaching the wheels and providing for a low-friction rotation of the wheels with respect to the apparatus main body. The provision of an access passage way to insert or extract ball-bearings assists with handling and provides for efficient interchangeability of wheels for different requirements. Further, the apparatus requires relatively few components, which helps with maintenance and reduces construction costs.

In addition, ball-bearings of different sizes may be used if required for different types of wheel or if a different degree of clearance between the wheel and the support member is required.

The design of the apparatus allows it to engage with the wellbore wall and operate over a range of tilts. The roller wheel profile assists with access in narrow wellbores.

Various modifications and improvements may be made within the scope of the invention herein described.

What is claimed is:

1. A transport assembly configured to be attached to a downhole apparatus, wherein the transport assembly reduces friction between the downhole apparatus and a wellbore, the transport assembly comprising:

a support assembly configured to be attached to the downhole apparatus and comprising a main longitudinal axis;

a ground engaging assembly configured to contact with and move in relation to a surface of a wellbore, the ground engaging assembly engaging with the support assembly to provide for relative rotation between the ground engaging assembly and the support assembly, at least one retaining member disposed between the ground engaging assembly and the support assembly, and being operable to resist separation of the ground engaging assembly from the support assembly, the transport assembly being further configured such that, when the transport assembly is in use moving along the wellbore, the ground engaging assembly bears against the at least one retaining member and the at least one retaining member bears against the support assembly;

wherein the retaining member is substantially spherical and arranged to both retain the ground engaging assembly on the support assembly and reduce friction between the ground engaging assembly and the support assembly;

wherein the ground engaging assembly is configured to rotate around a radial axis which is perpendicular to the main longitudinal axis of the support assembly to reduce friction between the downhole apparatus and the surface of the wellbore resulting from movement of the downhole apparatus through the wellbore along the longitudinal axis of the wellbore.

2. The transport assembly as claimed in claim 1, configured such that the at least one retaining member provides for freedom of movement of the ground engaging assembly and the support assembly in relation to each other.

3. The transport assembly as claimed in claim 1, wherein the at least one retaining member is movable in relation to each of the ground engaging assembly and the support assembly.

4. The transport assembly as claimed in claim 1, wherein the ground engaging assembly and the support assembly define a space in which the at least one retaining member is held.

5. The transport assembly as claimed in claim 4, wherein the transport assembly includes pressure equalizing apparatus operative to equalize a pressure in a space in which the at least one retaining member is held with an ambient pressure.

6. The transport assembly as claimed in claim 5, wherein the transport assembly includes an aperture configured to admit the at least one retaining member and wherein the pressure equalizing apparatus is disposed in a passageway defined between the aperture and the space defined by the ground engaging assembly.

7. The transport assembly as claimed in claim 5, wherein the pressure equalizing apparatus includes a closing body which, in use, is inserted into the passageway to close the passageway.

8. The transport assembly as claimed in claim 7, wherein the closing body defines a bore that is operative to equalize pressure in the space in which the at least one retaining member is held with the ambient pressure.

9. The transport assembly as claimed in claim 1 wherein one of the ground engaging assembly and the support assembly defines a recess for receiving a part of the other of the ground engaging assembly and the support assembly.

10. The transport assembly as claimed in claim 9, wherein the ground engaging assembly defines a part receiving recess for receiving a part of the support assembly.

11. The transport assembly as claimed in claim 10, wherein the part receiving recess extends in a direction substantially in line with a surface over which the transport assembly moves when in use.

12. The transport assembly as claimed in claim 10, wherein each of the ground engaging assembly and the support assembly defines a retaining recess and the at least one retaining member extends in part into each of the retaining recesses, and wherein the retaining recesses extend substantially radially of a direction in which the part receiving recess extends, for resisting separation of the ground engaging assembly and the support assembly.

13. The transport assembly as claimed in claim 10, wherein the transport assembly comprises a plurality of retaining members, the retaining members being spaced apart around the part of the support assembly received in the ground engaging assembly.

14. The transport assembly as claimed in claim 9, wherein, when the ground engaging assembly defines the recess for receiving a part of the support assembly, the support assembly includes a support member comprising a first, inner end adapted to be attached to the downhole apparatus and a second, outer end, and the part receiving recess is adapted to receive the outer end of the support member.

15. The transport assembly as claimed in claim 1, wherein each of the ground engaging assembly and the support assembly defines a retaining recess and the at least one retaining member extends in part into each of the retaining recesses.

16. The transport assembly as claimed in claim 15, wherein the ground engaging assembly and the support assembly define a space in which the at least one retaining member is held, wherein the space of the support assembly is a circumferential groove around the outside of the support assembly and the space of the ground engaging assembly is a circumferential groove around the inside of the ground engaging assembly for defining the retaining recess, and wherein part of the retaining member extends into each of the grooves, and wherein the radial axis is coincident with a central axis of the circumferential groove.

17. The transport assembly as claimed in claim 1, wherein the transport assembly includes an aperture configured to admit the at least one retaining member.

18. The transport assembly as claimed in claim 17, wherein the transport assembly defines a passageway between the aperture and a space defined by the ground engaging assembly and the support assembly, the space holding the at least one retaining member in its operative position.

19. The transport assembly as claimed in claim 18, wherein the passageway is an internal passageway formed in a part of at least one of the ground engaging assembly and the support assembly.

20. The transport assembly as claimed in claim 1, wherein the ground engaging assembly includes a contact member adapted to be operable upon contact with a wall of the wellbore.

21. The transport assembly as claimed in claim 20, wherein the contact member is adapted to rotate with respect to the support assembly.

22. The transport assembly as claimed in claim 21, wherein the retaining member is operable to guide rotation of the contact member with respect to the support assembly.

23. The transport assembly as claimed in claim 1, wherein the ground engaging assembly forms a unitary body.

24. The transport assembly as claimed in claim 1, wherein the support assembly forms a unitary body.

25. The transport assembly as claimed in claim 1, further comprising a seal member adapted to provide a seal between a part of the ground engaging assembly and a part of the support assembly and/or the downhole apparatus for preventing ingress of dirt, debris and particles from the wellbore from accessing the retaining member and interfering with operation of the transport assembly.

26. A downhole apparatus having a transport assembly configured to reduce friction between the downhole apparatus and a wellbore comprising:

a support assembly configured to be attached to the downhole apparatus and comprising a main longitudinal axis;

a ground, engaging assembly configured to contact with and move in relation to a surface of the wellbore, the ground engaging assembly engaging with the support assembly to provide for relative rotation between the ground engaging assembly and the support assembly, at least one retaining member disposed between the ground engaging assembly and the support assembly, the at least one retaining member being operable to resist separation of the ground engaging assembly from the support assembly, the transport assembly being: further configured such that, when the transport assembly is in use moving along the wellbore, the ground engaging assembly bears against the at least one retaining member and the at least one retaining member bears against the support assembly;

wherein the retaining member is substantially spherical and arranged to both retain the ground engaging assembly on the support assembly and reduce friction between the ground engaging assembly and the support assembly;

wherein the ground engaging assembly is configured to rotate around a radial axis which is perpendicular to the main longitudinal axis of the support assembly to reduce friction between the downhole apparatus and the surface of the wellbore resulting from movement of the downhole apparatus through the wellbore along the longitudinal axis of the wellbore.

27. The downhole apparatus as claimed in claim 26, wherein the downhole apparatus comprises a grease point access port configured to allow access of grease to a space in which the at least one retaining member is held.

28. The downhole apparatus as claimed in claim 26, wherein the apparatus includes a seal adapted to seal between a part of the ground engaging assembly and a part of the support assembly for preventing ingress of dirt, debris and particles from the wellbore from accessing the retaining member.

29. The downhole apparatus as claimed in claim 28, wherein the support assembly has a recess for receiving the seal.

30. The downhole apparatus as claimed in claim 28, wherein the apparatus has a main body formed of two body sections attached together using fixing screws.

31. The downhole apparatus as claimed in claim 30, wherein the main body includes the support assembly.

32. The downhole apparatus as claimed in claim 26, wherein the downhole apparatus includes a plurality of engaging discs for contacting a wall of the wellbore.

33. The downhole apparatus as claimed in claim 32, wherein the discs are selected from a group of discs having different outer surface profiles.

34. The downhole apparatus as claimed in claim 33, wherein the discs have continuous rounded outer surfaces to enhance a contact surface area with curved internal walls of a wellbore.

* * * * *

UNITED STATES PATENT AND TRADEMARK OFFICE

CERTIFICATE OF CORRECTION

PATENT NO. : 8,011,429 B2
APPLICATION NO. : 12/163058
DATED : September 6, 2011
INVENTOR(S) : McNay It is certified that error appears in the above-identified patent and that said Letters Patent is hereby corrected as shown below:

Column 11

Claim 26, line 17, delete "," after "ground"; and at line 26, delete ":" after "being".

Signed and Sealed this
Eighth Day of November, 2011

David J. Kappos

David J. Kappos
*Director of the United States Patent and Trademark Office*